US006579800B2

(12) United States Patent
Basol et al.

(10) Patent No.: US 6,579,800 B2
(45) Date of Patent: Jun. 17, 2003

(54) CHEMICAL MECHANICAL POLISHING ENDPOINT DETECTION

(75) Inventors: Bulent Basol, Manhattan Beach, CA (US); Homayoun Talleh, San Jose, CA (US)

(73) Assignee: NuTool, Inc.

( * ) Notice: Subject to any disclaimer, the term of this patent is extended or adjusted under 35 U.S.C. 154(b) by 0 days.

(21) Appl. No.: 09/976,469

(22) Filed: Oct. 12, 2001

(65) Prior Publication Data

US 2003/0073319 A1 Apr. 17, 2003

(51) Int. Cl.[7] ..... H01L 21/302
(52) U.S. Cl. ..... 438/692
(58) Field of Search ..... 438/16, 692

(56) References Cited

U.S. PATENT DOCUMENTS 5,131,060 A * 7/1992 Sakata ..... 385/2
5,461,007 A * 10/1995 Kobayashi ..... 438/16
6,108,092 A * 8/2000 Sandhu ..... 356/382
6,121,147 A 9/2000 Daniel et al. ..... 438/692
6,190,234 B1 * 2/2001 Swedek et al. ..... 451/6
6,191,864 B1 * 2/2001 Sandhu ..... 356/503
6,224,460 B1 * 5/2001 Dunton et al. ..... 451/6
6,247,998 B1 * 6/2001 Wiswesser et al. ..... 451/6
6,258,205 B1 7/2001 Chisholm et al. ..... 156/345
6,307,628 B1 * 10/2001 Lu et al. ..... 356/382
6,336,841 B1 * 1/2002 Chang ..... 451/10

* cited by examiner

*Primary Examiner*—David Nelms
*Assistant Examiner*—Thao Le
(74) *Attorney, Agent, or Firm*—NuTool Legal Department

(57) ABSTRACT

The present invention provides apparatus and methods for detecting removal of a material in a chemical mechanical polishing process that uses a solution and operates upon a top layer made of a material that is disposed over another layer on a multi-layer workpiece. When the top layer from the workpiece is removed using chemical mechanical polishing with the solution, a flow of used solution results, with the flow of used solution containing therein the material removed from the top layer. While removing the top layer, a beam of light is transmitted on the flow of used solution to obtain an output beam of light that is altered due to absorption by the material, and a change in a characteristic of the output beam of light from the beam of light indicative of a change in an amount of the material within the flow of used solution is detected.

15 Claims, 4 Drawing Sheets

CHEMICAL MECHANICAL POLISHING ENDPOINT DETECTION

BACKGROUND OF THE INVENTION

1. Field of the Invention

The present invention relates to manufacture of semiconductor integrated circuits and more particularly to a method of chemical mechanical polishing of conductive layers.

2. Description of the Related Art

Conventional semiconductor devices generally include a semiconductor substrate, usually a silicon substrate, and a plurality of sequentially formed dielectric interlayers such as silicon dioxide and conductive paths or interconnects made of conductive materials. Copper and copper alloys have recently received considerable attention as interconnect materials because of their superior electromigration and low resistivity characteristics. Interconnects are usually formed by filling copper in features or cavities etched into the dielectric interlayers by a metallization process. The preferred method of copper metallization process is electroplating. In an integrated circuit, multiple levels of interconnect networks laterally extend with respect to the substrate surface. Interconnects formed in sequential interlayers can be electrically connected using vias or contacts.

In a typical process, first an insulating interlayer is formed on the semiconductor substrate. Patterning and etching processes are performed to form features such as trenches and vias in the insulating layer. Typically the width of the trenches is larger than the width of the vias. After coating features on the surface with a barrier and then a seed layer, copper is electroplated to fill the features. However, the plating process, in addition to the filling the features, also results in a thick copper layer on the top surface of the substrate. This excess copper is called overburden and it should be removed before the subsequent process steps. FIG. 1A shows an exemplary portion 8 of such plated substrate 9, for example a silicon wafer. As shown in FIG. 1A, vias 10, 12 and a trench 13 are formed in an insulation layer 14, such as a silicon dioxide layer, that is formed on the substrate 9. The vias 10,12 and the trench 13 as well as top surface 15 of the insulation layer 14 are covered and filled with a deposited copper layer 16 through electroplating process. Conventionally, after patterning and etching, the insulation layer 14 is first coated with a barrier layer 18, typically, a Ta or Ta/TaN composite layer. The barrier layer 18 coats the vias and the trench as well as the surface of the insulation layer to ensure good adhesion and acts as a barrier material to prevent diffusion of the copper into the semiconductor devices through the insulation layer. Next a seed layer (not shown), which is often a copper layer, is deposited on the barrier layer. The seed layer forms a conductive material base for copper film growth during the subsequent copper deposition. As the copper film is electroplated, the deposited copper layer 16 quickly fills the vias 10, 12 but coats the wide trench 13 and the surface 15 in a conformal manner. When the deposition process is continued to ensure that the trench is also filled, a thick copper layer or overburden is formed on the substrate 9. Conventionally, after the copper plating, various material removal processes, for example chemical mechanical polishing (CMP), etching or electroetching can be used to remove the unwanted overburden layer. Conventionally, after the copper plating, chemical mechanical polishing (CMP) process is employed to globally planarize and then reduce the thickness of the copper layer down approximately to the level of the surface of the insulation layer.

The CMP process conventionally involves pressing a semiconductor wafer or other such substrate against a moving polishing surface that is wetted with a polishing solution, which polishing solution can also be a chemically reactive abrasive slurry. The slurries are usually either basic or acidic and generally contain alumina, ceria, silica or other hard ceramic particles. The polishing surface is typically a planar pad made of materials well known in the art of CMP. The polishing solution may be flowed over the pad or may be flowed through the pad if the pad is porous in the latter case. During a CMP process a wafer carrier with a wafer to be processed is placed on a CMP pad and pressed against it with controlled pressure while the pad is rotated. The pad may also be configured as a linear polishing belt that can be moved laterally as a linear belt. The process is performed by moving the wafer against the pad, moving the pad against the wafer or both as polishing solution is supplied to the interface between the pad and the wafer surface.

As shown in FIG. 1B, CMP is first applied to reduce the thickness of the copper layer down to the barrier layer that covers the surface. Subsequently, the barrier layer on the surface is removed to confine the copper and the barrier in the vias and trenches. However, during these processes, determining the polishing endpoint, whether the copper layer is polished down to the barrier layer or the barrier layer is polished down to the oxide layer, is one of the important problems in the industry. Typically, in one group of prior art, the substrate is removed from the CMP device and the thickness of the copper layer is measured ex-situ to see if the desired endpoint has been reached. Because, this process interrupts the normal process cycle, it is time consuming and reduces the throughput. Also, the measurements may reveal that the endpoint has been exceeded and the substrate is over polished, which may render the substrate useless. On the other hand, under polishing of the copper layer leads to failure in isolation and causes electrical shorts.

Another group of prior art involves in-situ methods such as electrical or optical methods, or in some cases acoustical methods, to determine endpoint. Most of these methods involve monitoring a parameter associated with the substrate surface and indicating an endpoint when the parameter abruptly changes. For example, one electrical method is to sense the changes in the friction between the wafer and the polishing pad by sensing the motor current utilized by the system or current of the motor utilized by the system. The motor current method relies on detecting the dissimilar coefficient of friction between the polishing pad and the layers that are being polished and stops polishing when a transition is sensed. However, if the overlying and A underlying materials in the polished structure have similar coefficients of friction, sensing transitions from one material to the other becomes difficult. In other examples, optical endpoint detection systems can be used with rotating pad or linear belt systems having a window or windows in them. In such cases as the pad or the belt moves, the openings made therein pass over an in-situ monitor that takes reflectance measurements that are obtained from the wafer surface and reflected through the openings. Changes in the reflection indicate the endpoint of the polishing process. However, windows opened in the polishing pad complicate the polishing process and disturb the homogeneity of the pad or the belt. Additionally, such windows may cause accumulation of polishing by-products and slurry.

U.S. Pat. No. 6,121,147 describes a method in which atomic absorption spectroscopic techniques are used to detect the presence of a metallic substance in the material removed from the wafer. Such techniques are both expensive to implement as well as difficult to operate in a manner that provides real-time results.

U.S. Pat. No. 6,258,205 also teaches an end-point detection method that requires the insertion of an endpoint layer with a catalyst material disposed therein. As a result, when the endpoint layer is removed, the catalyst material will react with a reagent in the solution, and that reaction can cause a detectable change, which can be detected using a sensor.

Each of the above methods thus has drawbacks of one sort or another for end point detection.

Therefore, a continuing need exists for a method and apparatus which accurately and effectively detects an end-point on a substrate when the substrate is polished using CMP processes.

SUMMARY OF THE INVENTION

The above invention overcomes disadvantages mentioned above as one of its objects.

In one aspect, the present invention provides an apparatus for operating upon a multi-layer workpiece using a solution. The apparatus includes a chemical mechanical polisher adapted to remove a top layer from the workpiece, the polisher receiving the solution and emitting a flow of used solution, with the used solution containing therein material corresponding to the top layer that has been removed. The apparatus also includes an optical system adapted to transmit a beam of light on the used solution with a light source and detect an output beam of light with an optical detector, the optical system further adapted to provide an end-point signal to the polisher upon detection of a substantial change in a characteristic of the output beam of light within a predetermined wavelength range due to a substantial change in an absorption of the beam of light by the used solution, the change in absorption of the beam of light by the used solution occurring because of a change in an amount of the material within the flow of used solution, the end-point signal thereby indicating that the top layer has been removed.

In a particular embodiment, the characteristic of the output beam is the intensity.

In a further aspect, the present invention provides a method for detecting removal of a material in a chemical mechanical polishing process that uses a solution and operates upon a top layer made of a material that is disposed over another layer on a multi-layer workpiece. The method includes removing the top layer from the workpiece using chemical mechanical polishing with the solution, the step of removing causing a flow of used solution to result, with the flow of used solution containing therein the material removed from the top layer. While removing the top layer, the method transmits a beam of light on the flow of used solution to obtain an output beam of light that is altered due to absorption by the material, and detects a change in a characteristic of the output beam of light from the beam of light indicative of a change in an amount of the material within the flow of used solution.

In a particular embodiment of this method, the step of detecting the change in the output beam of light generates an electrical signal indicative of the change in the output beam of light from the beam of light, and further including the step of generating an end-point signal to halt the step of removing when the material corresponding to the top layer is substantially reduced within the used solution based upon the electrical signal, the end-point signal thereby indicating that the top layer has been removed.

In another aspect, the invention provides an apparatus for operating upon a multi-layer workpiece using a solution. The apparatus includes a chemical mechanical polisher adapted to remove a top layer from the workpiece, the polisher receiving the solution and emitting a flow of used solution, the used solution initially containing therein material corresponding to the top layer that has been removed and subsequently containing therein another material corresponding to another layer below the top layer. The apparatus also includes an optical system adapted to transmit a beam of light on the used solution with a light source and detect an output beam of light with an optical detector, the optical system further adapted to provide an end-point signal to the polisher upon detection of a substantial change in a characteristic of the output beam of light within a predetermined wavelength range due to a substantial change in an absorption of the beam of light by the used solution, the change in absorption of the beam of light by the used solution occurring because of a change in an amount of another material within the flow of used solution, the end-point signal thereby indicating that the top layer has been removed.

Other aspects and advantages of the invention are described hereinafter, and particularly in the claims.

BRIEF DESCRIPTION OF THE DRAWINGS

These and other objects, advantages and aspects of the present invention will become apparent and more readily appreciated from the following detailed description of the presently preferred exemplary embodiments of the invention taken in conjunction with the accompanying drawings, of which.

DETAILED DESCRIPTION OF THE PREFERRED EMBODIMENT

As will be described below, the present invention provides a method and a system for an in-situ endpoint detection for material removal processes. Although the endpoint detection system of the present invention is described with chemical mechanical polishing (CMP), the present invention can also be used with other material removal processes such as etching and electroetching, to remove a top layer or layers from a multilayer workpiece.

Figure 2:
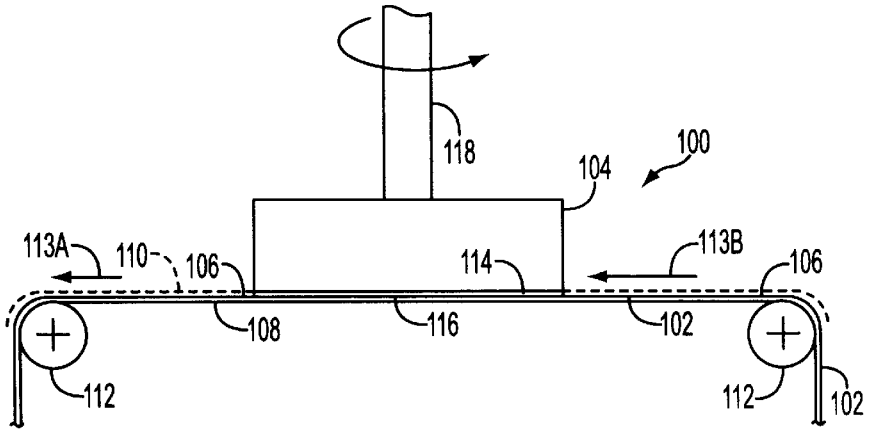
FIG. 2 illustrates a chemical mechanical polishing (CMP) apparatus.

Reference will now be made to the drawings wherein like numerals refer to like parts throughout. FIG. 2 shows an exemplary chemical mechanical polishing (CMP) apparatus 100 that includes a polishing belt 102 and a carrier head 104. The belt includes an upper or process surface 106 and a lower surface 108. A polishing solution 110 is flowed on the process surface 106 of the belt 102, and the belt is moved over a set of rollers 112 either in unidirectional or bi-directional manner by a moving mechanism (not shown). The polishing solution, which if copper is being polished may be a copper polishing solution such as CPS-8 obtained from the 3M Company, or other polishing solution such as an abrasive slurry. The solution may be fed from one or both sides of the wafer onto the pad, or it may also be fed onto the wafer surface through the polishing pad, or both. A typical rate at which the solution is fed to the wafer is 300 cc/min, and the used or outgoing solution leaves the system at approximately the same rate. In this example provided, the used solution is emitted in a flow in the direction of arrow 113A and the fresh or incoming solution enters the system in the direction of arrow 113B. A wafer 114 to be processed is held by the carrier head 104 so that a front surface 116 of the wafer is, which will be referred to as surface hereinafter, fully exposed. The head 104 may move the wafer vertically up and down as well as rotate the wafer 114 through a shaft 118.

Figure 1A:
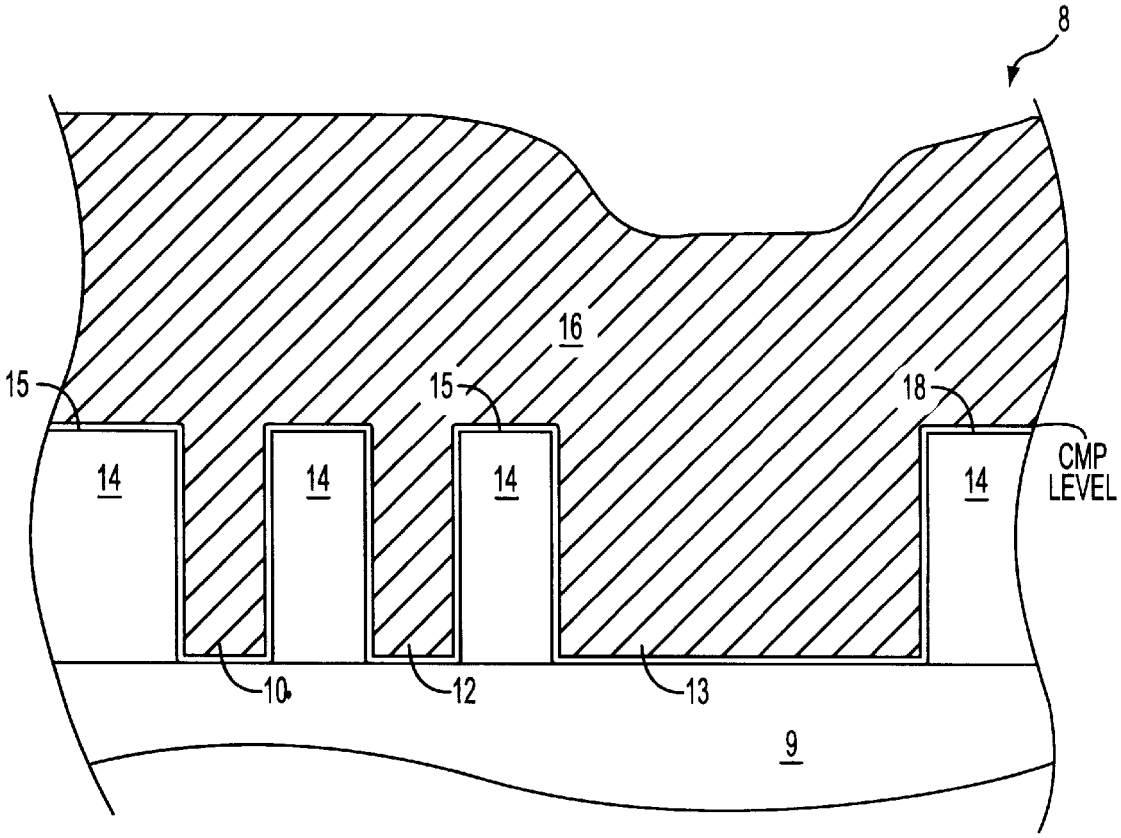
FIGS. 1A and 1B illustrate an exemplary portion a plated substrate at different processing points.
Figure 1B:
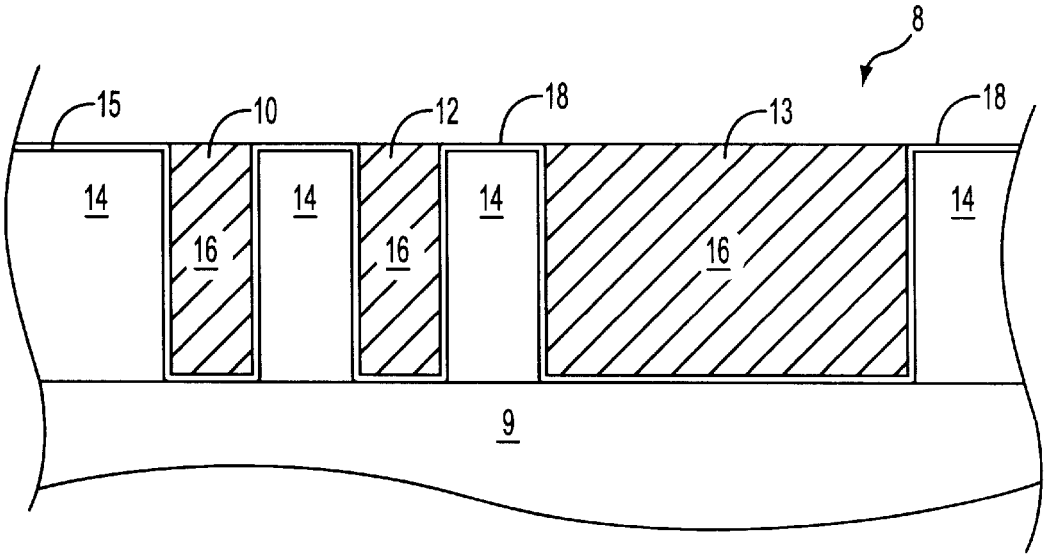

The surface 116 of the wafer 114 has the structure shown in FIG. 1A with a copper layer 16 (that includes both the seed layer and the deposited copper) that can be polished down to barrier layer 18 therebelow (as shown FIG. 1B), while the endpoint detection is performed in-situ using the present invention. Although copper is used as an example material herein, the present invention may also be used in the removal of other materials, for example conductors such as Ni, Pd, Pt, Au, Pb, Sn, Ag, and their alloys, Ta, TaN, Ti and TiN, as well as insulators and semiconductors. During the process, the wafer 114 is rotated and the surface 116 is contacted by the process surface 106 of the belt 102 that is moved while the polishing solution 110 is flowed on the process surface 106 and wets the surface 116 of the wafer.

The endpoint detection method of the present invention involves detection of a change in a color characteristic, which color characteristic change is associated with a change in the constituent of the used solution.

In one embodiment, this change in the constituent of the used solution will typically occur as a result of material being removed from the surface 116 of the wafer 114, and then being added to the used solution. Once the layer containing the material is substantially removed, a reduction or elimination of the material as a by-product of the used solution will occur. It is noted that while a small amount of the material may be included within the lower layer, such as copper within vias, that the amount of material will still be substantially reduced when the lower layer containing a different material is being removed, and thus trace amounts of material that will still exist within the used solution can be discriminated.

In another embodiment, this change in the constituent of the used solution will occur as a result of the inclusion of a new by-product material as a result of a new lower layer being removed.

In each of the preferred embodiments mentioned above, the present invention uses optical methods to indicate when that material corresponding to a particular layer either is no longer being removed or is being newly removed.

For the preferred embodiment in which the material of the layer being removed is being detected, and where that material is copper, the endpoint detection is thus based on the detection of copper in the outgoing used solution. In this preferred embodiment, the presence of copper in the outgoing used solution gives the used solution a particular color, a blue-green color when using the CPS-8 solution referred to above, which changes from a yellowish color that this solution will have without the copper being disposed therein. During the process, as the surface 116 of the wafer 114 is polished, copper is removed from the surface 116 and is carried away by the outgoing used solution. As long as the copper layer is polished away, the copper concentration in the outgoing used solution varies within a predicable range, staying almost steady, and the solution retains the blue-green color. However, once the copper layer 16 above the barrier layer 18 is removed copper concentration in the solution drastically drops and the color of the solution changes, approaching a new color as a result of a new barrier layer material also being removed.

It is understood that although the present invention is described using copper and this particular solution brand will have a blue-green color with copper present therein, and using other solutions that may have other colors when copper is present is entirely within the scope of this invention. Further, the same endpoint detection can be performed using other materials (including metals, insulators, and other semiconductor layers) and polishing solutions, using the same principles.

In accordance with the principles of the present invention, this drop in copper concentration, and thus the color change, can be detected using a detector, which can then generate a signal indicating the endpoint of the desired polishing operation an be used to halt the CMP process.

Using the preferred optical detection method, the presence of a material in the outgoing used solution will change the color of the outgoing used solution. This change in color will result in a corresponding change in the intensity of light transmitted through the used solution at specific wavelengths corresponding to that color, which is due to absorption by the material of those wavelengths. For example, in removing a copper layer with the CPS-8 solution mentioned above, with copper no longer substantially present in the outgoing used solution, the blue-green color will no longer exist, and the particular wavelength's absorbing efficiency by the blue-green color will no longer be as great.

Figure 3:
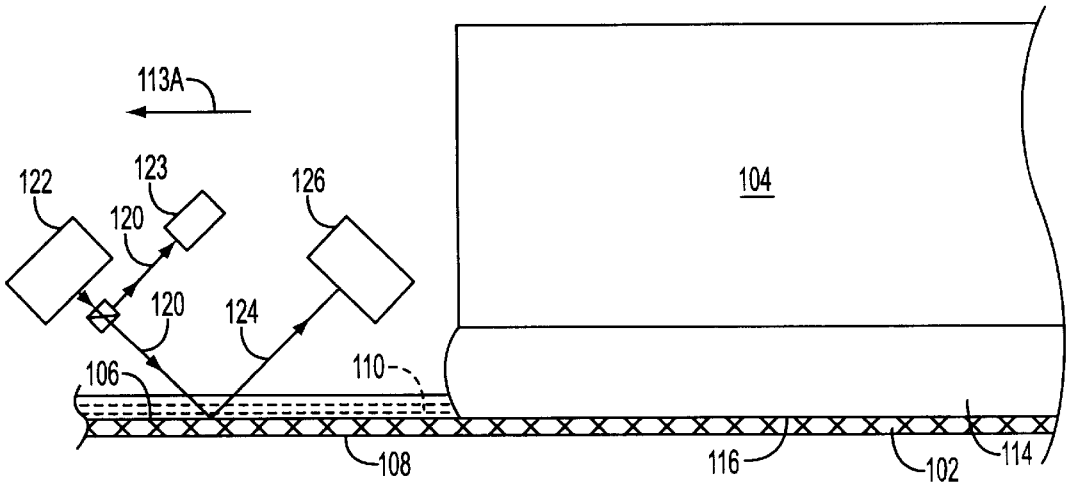
FIG. 3 illustrates an optical detection system used with a CMP apparatus according to the present invention.

As shown in FIG. 3, a optical beam 120 sent from a light source 122. An exemplary light source is a single wavelength laser or spectrophotometer, or a light bulb with a filter that only allows predetermined wavelengths to pass, which will generate, continuously or intermittently, the input optical beam 120. A portion of this beam will be used to obtain a sample signal using a sample detector 123 to determine the intensity of the input optical beam 120, with another portion of this beam 120 being passed through the solution 116 to generate an output optical beam 124. Any of a number of beam splitting techniques can be used to route different portions of the beam to various places. Further, if the light source generates a beam having a known steady intensity, the intensity measurement is not necessary. The output optical beam 124 is thus received and detected at a detector 126. Exemplary detectors used for both the sample detector 123 and the detector 126 may be various thermopile type detectors, photodiodes, or spectrometers, such as Model 410 Visible Spectrometer available from Spectral Instruments of Tucson, Ariz. The detectors 123 and 126 may also be the same detector, with light beams being routed to the detector at various points in time in a uniform manner, as is known.

The difference in the intensity of the input optical beam 120 and the output optical beam 124 at the wavelengths of interest are proportional to the copper concentration of the outgoing solution.

In this embodiment the input optical beam 120 will preferably have a predetermined wavelength ($\lambda$), or a predetermined range of wavelengths. The predetermined wavelengths can be determined by transmitting a test beam of varying wavelength through the unused solution to understand the color (spectral characteristics) of the solution.

Figure 4:
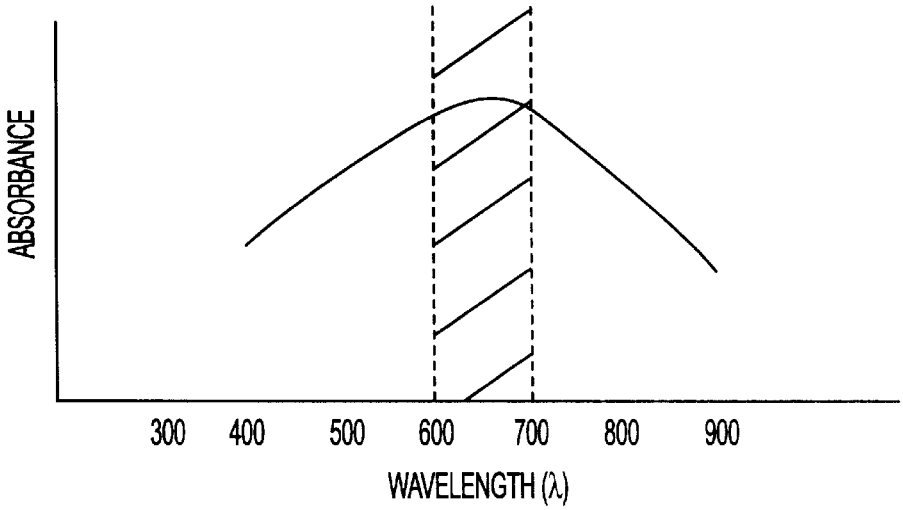
FIG. 4 illustrates a representative graph of wavelength ranges corresponding to absorption of copper in a plating solution according to the present invention.

Thereafter, the test beam can be transmitted through the used solution that contains the material of interest therein to understand the difference in color caused by the material, and in particular determine a wavelength range that renders the highest light absorption, such as shown in FIG. 4. Thereafter, for greatest sensitivity in measurements, various concentrations of the material of interest in the used solution can be tested to determine if the wavelength range that renders the highest light absorption remains constant throughout the various concentration levels, although this additional testing is not believed necessary.

Once the predetermined color (or specifically wavelength, or wavelength range of highest absorption) that will be created as a result of the material is determined, it is known that the intensity of this wavelength range of the output optical beam 124 will be reduced in the presence of the material. In other words, absorption of the input optical beam at these wavelengths by the solution causes the output optical beam with reduced intensity at these wavelengths. Detection operation may then be initiated as soon as the material removal from the surface 116 begins.

Once the wavelength range of interest is determined, the input optical beam 120 having the predetermined wavelength is sent through the outgoing used solution with the polishing of the layer having the material therein occurring. As shown in FIG. 4, the predetermined wavelength range may preferably be between 600 and 700 nanometers for copper. After the absorption of the input optical beam 120 by the outgoing used solution, the resulting output optical beam 124 will have a lower intensity within that wavelength range. This lower intensity will continue consistently as long as the copper polishing continues. Once, however, the copper layer, i.e., the copper layer 16 is planarized down to the CMP level, which corresponds to the top surface of the barrier layer 18 as indicated in FIG. 1A, copper concentration in the outgoing solution and hence the absorption of the input optical beam 120 is reduced. As a result, the intensity of the wavelength range of the output optical beam 124 approaches the intensity of the transmitted wavelengths in the input optical beam 124. Once this change in the outgoing solution is detected, a detection signal is generated and used to thereby halt the CMP process.

Figure 5:
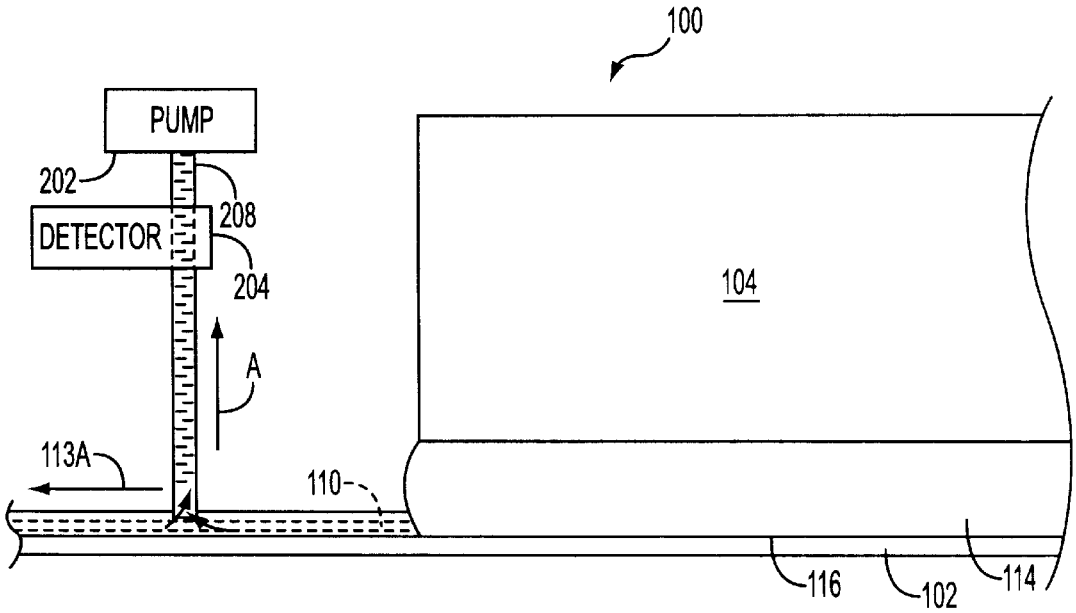
FIG. 5 illustrates another optical detection system used with a CMP apparatus according to the present invention.

In operation, an in-situ endpoint detection system may be a part of the CMP system 100 shown in FIG. 2. As shown in FIG. 5, a detection system 200 may comprise a polishing solution suction pump 202 and an absorption detector 204. In this embodiment, a conduit 208 made of a transparent material at least at the location corresponding to the absorption detector 204 has one end placed into the outgoing used solution and the other end is connected to the polishing solution suction pump 202 to cause a portion of the outgoing used solution to continuously flow therethrough. As the outgoing used solution flowing through the conduit 208 passes through the detector system 204, the above described detection process is performed.

Figure 6:
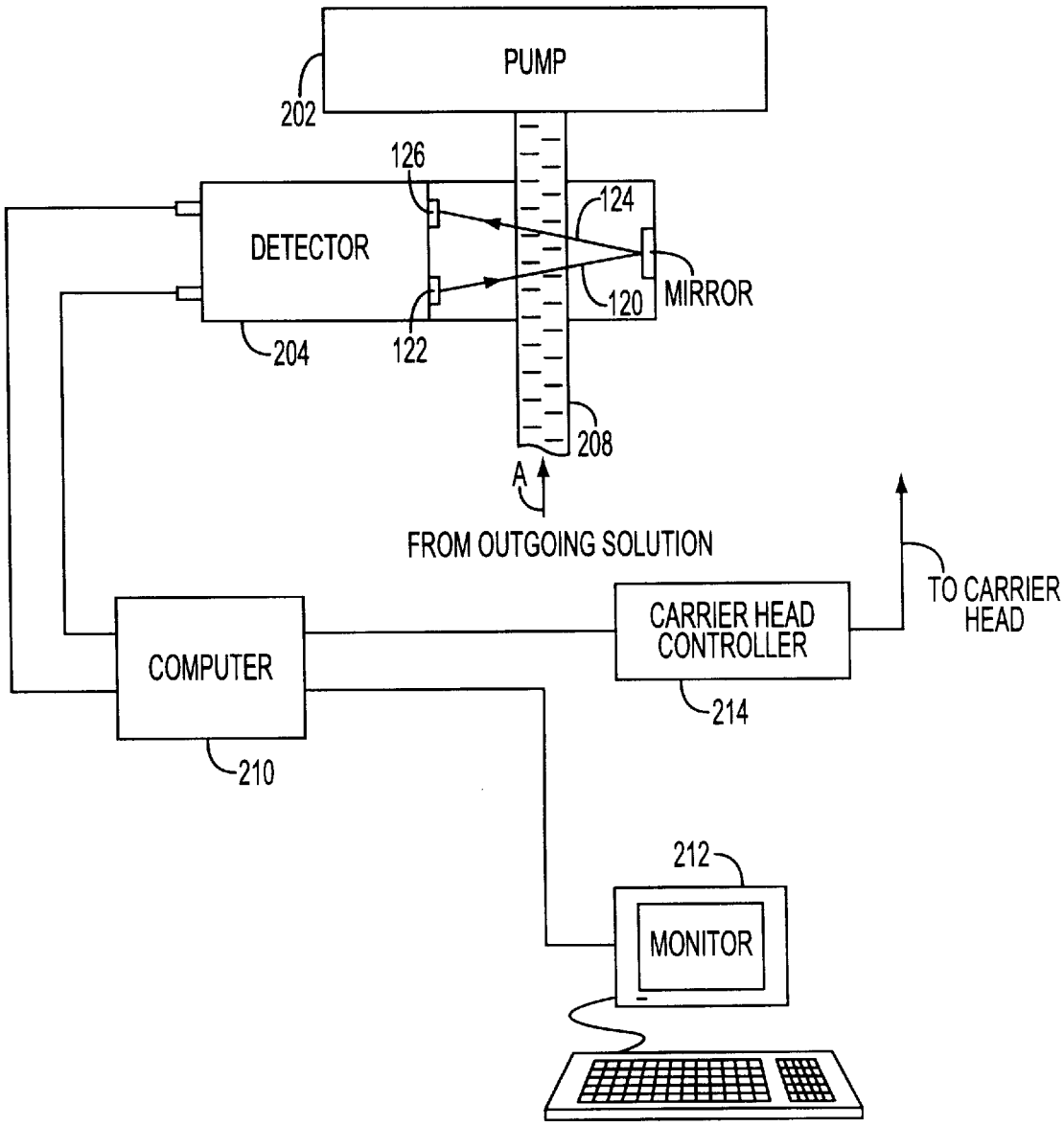
FIG. 6 illustrates a more detailed view of portions of the optical detection system of FIG. 5.

As shown in FIG. 6, in the preferred embodiment, the detector 204 is connected to a computer 210, which computer 210 is also electrically connected to a carrier head controller 214, although it is understood that the computation could be performed in many manners, and need not necessarily require a computer with a processor, but instead could use discrete or integrated logic circuits, including but not limited to ASICS and programmable gate arrays. When operating on a copper layer with a barrier layer beneath, when the barrier layer is exposed, the detector output signal from the detector 204 will change as a result of the change in the amount of the material within the outgoing used solution.

Thus, by continuously monitoring the detector output signal from the detector 204, as well as the sample signal indicating the intensity of the originally output light beam 120 are provided to computer so that the computer 210 can generate the end-point signal and provide the end-point signal to the carrier head controller 214 to halt the CMP process at the appropriate time. Thus, the end-point signal is generated based upon a change to the detector signal indicating that the amount of material, such as copper in the example being used, in the outgoing solution flow becomes minimized, thus indicating removal of the layer of interest.

While the invention is described as obtaining the sample signal, it is understood that the present invention can also be implemented without using the sample signal, and instead relying on changes to the detector signal alone.

FIG. 6 also shows the detector system 204 in more detail, as including both the input optical beam source 122 that generates the input optical beam 120 described above and the detector 126 that receives the output optical beam 124. Although shown using a mirror and being reflected, such reflection is not necessary, and the source 122 and the detector 126 can be disposed on opposite sides of the outgoing used solution flow.

Operation of the invention is modified when attempting to detect the presence of another material that is disposed in a layer directly below the layer with the material being removed. During such usage, the present invention will initially be set up to test for the color characteristics of another layer, and then while removal of the material within the layer occurs, the optical system will continuously attempt to detect the presence of the another material in the outgoing used solution, such as the tantalum in the barrier layer, or if the barrier layer is desired to be removed, the insulating material used to form the insulating layer below the barrier layer. Once the optical system detects the presence of another material in the outgoing used solution, the end-point signal will then be generated.

Although various preferred embodiments have been described in detail above, those skilled in the art will readily appreciate that many modifications of the exemplary embodiment are possible without materially departing from the novel teachings and advantages of this invention.

What is claimed is:

1. A method of polishing a multilayer workpiece using a polishing pad, polishing solution, light source and detector, comprising the steps of:

removing at least a portion of a top layer of the workpiece by polishing the workpiece with the polishing pad and solution, causing a flow of used solution containing material removed from the workpiece;

transmitting an incident light beam from the light source on the used solution; and detecting a change in a characteristic of an output light beam from the used solution due to the material removed from the workpiece and generating a detector signal.

2. The method according to claim 1 wherein the detecting step further includes the steps of:

determining a polishing endpoint based at least in part of the detector signal; and stopping the polishing step when the detector signal reaches a predetermined threshold.

3. The method according to claim 2 further including the step of determining a wavelength range of the light beam to transmit based at least in part on an absorption characteristic of the material removed from the workpiece in the used solution.

4. The method according to claim 3 wherein the wavelength range of the light beam is further based at least in part on an absorption characteristic of the used solution.

5. The method according to claim 3 wherein the detecting step detects as the characteristic of the output light beam a change in an intensity of the output light beam.

6. The method according to claim 5 wherein the detecting step detects when the intensity of the output light beam changes as the material removed from the workpiece within the used solution decreases.

7. The method according to claim 5 wherein transmitting step transmits a wavelength range corresponding to absorption of a conductor material removed from the workpiece.

8. The method according to claim 7 wherein the detecting step detects when the intensity of the output light beam increases as the material removed from the workpiece within the used solution decreases.

9. The method according to claim 5 wherein the detecting step detects when the intensity of the output light beam changes as an amount of copper material removed from the workpiece within the used solution decreases.

10. The method according to claim 3 wherein the determining step uses a sample signal obtained from the light source.

11. The method according to claim 1 wherein the detecting step detects as the characteristic of the output light beam a change in an intensity of the output light beam.

12. The method according to claim 11 wherein the detecting step detects when the intensity of the output light beam within a wavelength range changes as the material removed from the workpiece within the used solution decreases.

13. The method according to claim 11 wherein the transmitting step transmits a wavelength range corresponding to absorption of a conductor material removed from the workpiece.

14. The method according to claim 13 wherein the detecting step detects when the intensity of the output light beam changes as an amount of conductor material removed from the workpiece within the used solution decreases.

15. An integrated circuit manufactured including the steps of claim 1 where the workpiece is a semiconductor wafer.

* * * * *

UNITED STATES PATENT AND TRADEMARK OFFICE

CERTIFICATE OF CORRECTION

PATENT NO. : 6,579,800 B2
DATED : June 17, 2003
INVENTOR(S) : Bulent M. Basol and Homayoun Talieh It is certified that error appears in the above-identified patent and that said Letters Patent is hereby corrected as shown below:

Title page,
Item [75], Inventors, "Bulent Basol" should read -- Bulent M. Basol --; and Homayoun Talleh" should read -- Homayoun Talieh --.

Signed and Sealed this

Twenty-seventh Day of April, 2004

JON W. DUDAS
*Acting Director of the United States Patent and Trademark Office*